US007089704B2

(12) United States Patent
Jejina et al.

(10) Patent No.: US 7,089,704 B2
(45) Date of Patent: Aug. 15, 2006

(54) ATTIC HATCH

(75) Inventors: Mark Jejina, Innisfail (CA); Jyri Laitinen, Innisfail (CA)

(73) Assignee: 982426 Alberta Ltd., Innisfail (CA)

( * ) Notice: Subject to any disclaimer, the term of this patent is extended or adjusted under 35 U.S.C. 154(b) by 0 days.

(21) Appl. No.: 10/249,315

(22) Filed: Mar. 31, 2003

(65) Prior Publication Data

US 2003/0182869 A1 Oct. 2, 2003

(51) Int. Cl.
*E04F 19/08* (2006.01)

(52) U.S. Cl. ..... 52/19; 52/DIG. 9; 52/309.9; 52/794.1

(58) Field of Classification Search ..... 52/19, 52/DIG. 9, 309.9, 794.1, 745.16, 780, 474, 52/764

See application file for complete search history.

(56) References Cited

U.S. PATENT DOCUMENTS 3,566,564 A * 3/1971 Gaeth et al. ..... 52/232
4,299,059 A 11/1981 Smith
4,563,845 A 1/1986 Stipe
4,567,074 A 1/1986 Litaker
4,658,555 A 4/1987 Steiner
4,944,126 A 7/1990 King
5,867,946 A 2/1999 Seagren
6,014,841 A 1/2000 McCoy, Jr. et al.
6,223,490 B1 5/2001 Wessley et al.
6,578,327 B1 * 6/2003 Hackbarth et al. ..... 52/202

FOREIGN PATENT DOCUMENTS

FR 2778423 11/1999
WO WO 95/08688 3/1995

OTHER PUBLICATIONS

"Windows and Doors", 1994, Sustainable Building Sourcebook.*

* cited by examiner

*Primary Examiner*—Naoko Slack
(74) *Attorney, Agent, or Firm*—Bennett Jones LLP

(57) ABSTRACT

A prefabricated attic hatch includes a frame comprising an outer frame and an inner frame. The inner frame encloses a central insulating panel which is fabricated from metal-skinned insulating foam. A preferred material for the panel is metal insulated door waste material. A method of fabricating attic hatches includes the use of metal insulated door waste material.

6 Claims, 3 Drawing Sheets

ATTIC HATCH

BACKGROUND OF INVENTION

The present invention relates to prefabricated insulated attic hatches for use in residential and commercial construction.

Openings into attics are common in most homes. In cold climates, the attic is not used for living space or for storage. Typically, an attic is filled with an insulating material, either fibreglass batting or foam chips, between the ceiling joists. The attic opening is usually covered with a hatch made from a piece of plywood or OSB framed with 2×4 or 2×6 lumber, which is fabricated on site using surplus materials. The hatch itself is often not insulated, or a small piece of fibreglass batting or rigid foam is glued to the topside of the hatch.

Therefore, there is a need in the art for a prefabricated, insulated attic hatch.

SUMMARY OF INVENTION

The present invention is directed to a pre-fabricated insulated attic hatch. In general terms, the hatch is configured to fit between the bottom pieces of adjacent roof trusses and framing members between the trusses. The hatch comprises a frame and a central insulating panel. In a preferred embodiment, the central insulating panel is a flat piece of insulating material which is clad on at least one of its upper and lower surfaces with a rigid material such as metal or fiberglass. The insulating material may be any plastic foam such as polyurethane foam or polystyrene foam. A preferred material for the central insulating panel is identical to that used to manufacture metal or fiberglass insulated doors.

Therefore, in one aspect, the invention comprises an attic hatch comprising an outer frame encircling a central panel comprising a metal clad insulating foam, wherein the central panel is metal clad on both sides and is framed by an inner frame.

In another aspect of the invention, the invention comprises a method of constructing an attic hatch comprising a central insulating panel, the method comprising the steps of receiving insulated metal door waste material and forming the central insulating panel from the waste material.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

Figure 1:
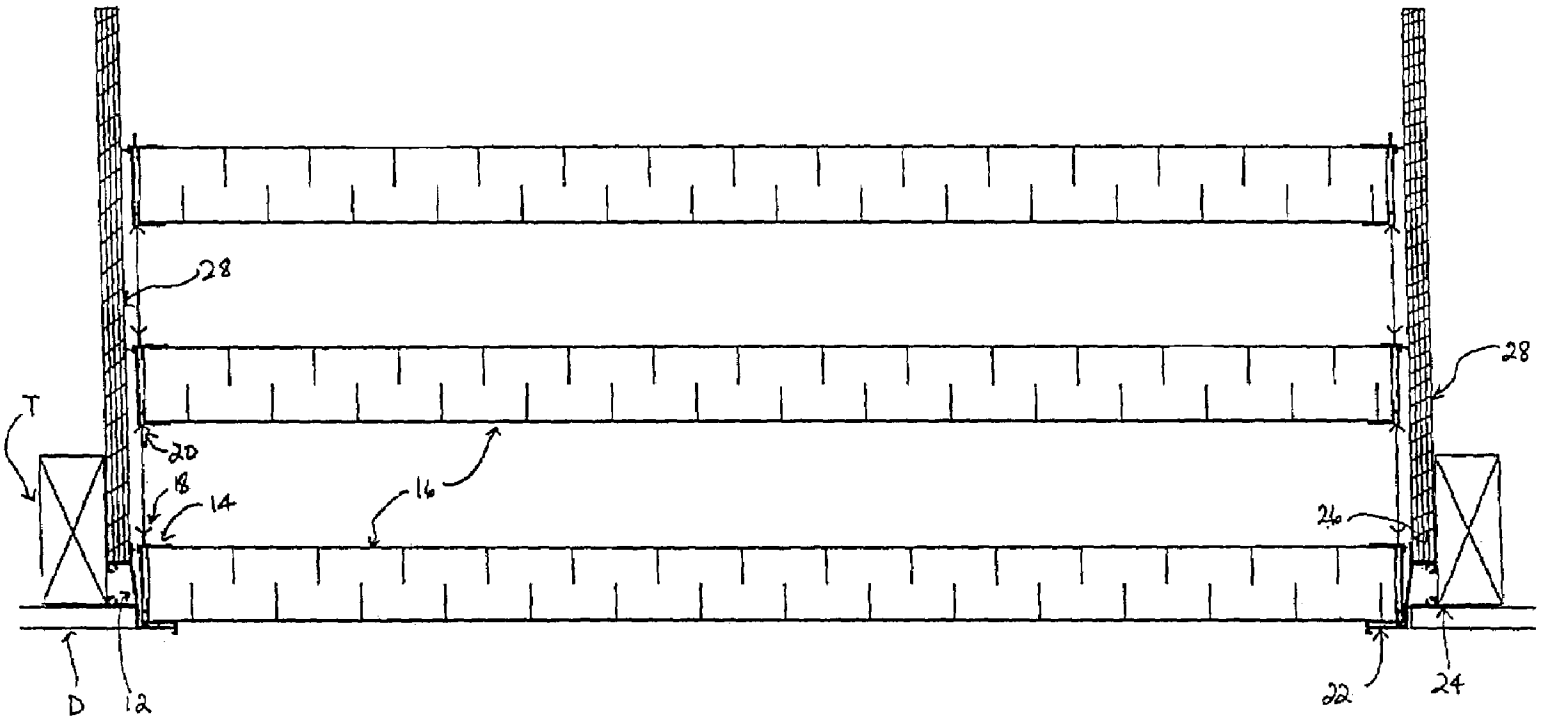
FIG. 1 is a cross-sectional view of one embodiment of the invention.
Figure 2:
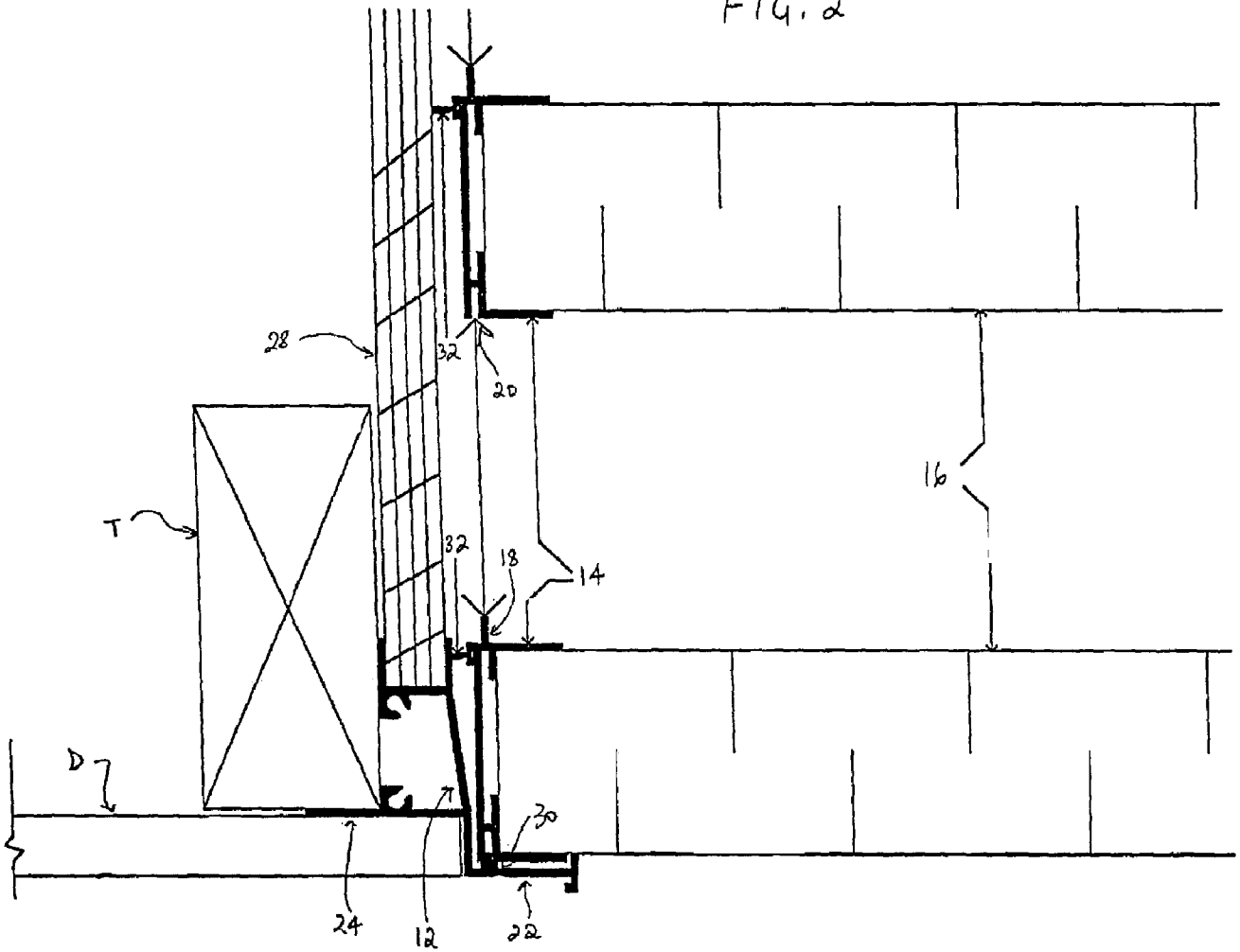
FIG. 2 is a detail cross-sectional view of one corner of the attic hatch shown in FIG. 1.
Figure 3:
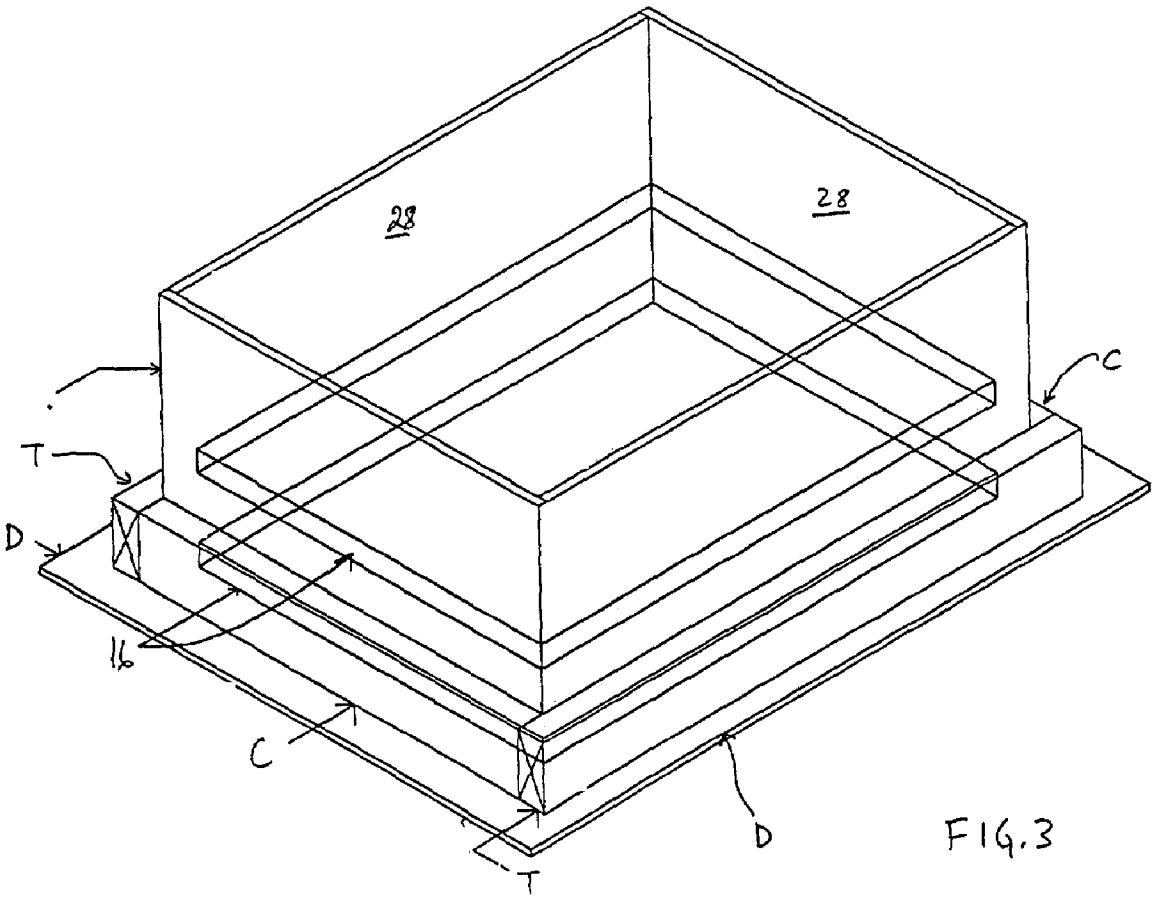
FIG. 3 is a schematic perspective view of one embodiment.

The present invention provides for a pre-fabricated insulated attic hatch. All terms not defined herein have their common art-recognized meanings.

As seen in the Figures, the invention comprises a rectangular hatch adapted to fit an attic opening in a residential or commercial building. It may fit between truss members (T) and cross pieces (C), which may be simple 2×4 lumber. A frame (10) includes an outer frame (12) and an inner frame (14). The inner frame (14) is preferably a PVC extrusion defining a channel which fits around the periphery of a rectangular central insulating panel (16). As is shown in a partially exploded view, a plurality of panels (16) may be stacked to provide additional insulating value. The inner frame may have a mating tongue (18) and groove (20) configuration to lock the stacked panels (16) into place.

Each panel (16) is preferably a fibreglass or metal skinned panel having a foam core, such as polyurethane or polystyrene foam, which are well known in the art. In a preferred embodiment, the panels are metal insulating door material, and more preferably recovered from waste material discarded during door manufacture. There is usually no use for such waste material and it is typically discarded to landfills. The dimensions of such waste material are usually such that panels of adequate size for attic hatches may be cut from them. As used herein, "waste material" refers to material remaining after the door cutout is made, regardless of whether the material is actually discarded or not.

The outer frame is preferably an aluminum extrusion which has a lower retaining flange (22) which serves to vertically support the panels (16). A perimeter flange (24) fits between a truss member (T) and the interior ceiling drywall (D), retaining the outer frame in position. A lip between the retaining flange (22) and the perimeter flange (24) keeps the retaining flange (22) flush with the drywall surface. Therefore, the bottom surface of the panel (16) and the retaining flange (22) may be painted or textured to match the rest of the ceiling.

A third section of the outer frame defines a channel (26) which supports a vertical divider (28), which may be plywood, oriented strandboard or a rigid plastic material. The purpose of the divider is to dam up any insulating material such as foam chips which is used to insulate the attic and prevent the escape of such material down the attic opening.

A flexible seal (30) between the outer frame (12) and the inner frame (14) prevents drafts. The inner frame (14) may have a peripheral seal (32) such as a mohair seal to provide additional sealing between the inner and outer frames (12, 14) and between the divider (28) and the inner frame (14) of stacked panels (16).

As will be apparent to those skilled in the art, various modifications, adaptations and variations of the foregoing specific disclosure can be made without departing from the scope of the invention claimed herein.

The invention claimed is:

1. An attic hatch comprising an outer frame encircling a central panel comprising a metal clad insulating foam, wherein the central panel is metal clad on both sides and is framed by an inner frame, wherein the outer and inner frames are rectangular and the inner frame fits closely within the outer frame, and wherein the outer frame comprises an upward facing groove for receiving a vertical separator.

2. The attic hatch of claim 1 wherein the inner frame comprises a tongue and groove configuration on opposing horizontal sides of the inner frame, such that identical inner frames may be stacked vertically with the tongue of one frame mating with the groove of an adjacent frame.

3. The attic hatch of claim 2 wherein the central panel comprises metal door waste material.

4. The attic hatch of claim 1 further comprising a resilient seal between the inner frame and outer frame.

5. The attic hatch of claim 1 wherein the central panel comprises metal door waste material.

6. An attic hatch comprising an outer frame encircling a central panel comprising a metal clad insulating foam, wherein the central panel is metal clad on both sides and is framed by an inner frame, wherein the outer and inner frames are rectangular and the inner frame fits closely within the outer frame, and wherein the inner frame comprises a tongue and groove configuration on opposing horizontal sides of the inner frame, such that identical inner frames may be stacked vertically with the tongue of one frame mating with the groove of an adjacent frame.

* * * * *